United States Patent [19]

Boyd

[11] 4,243,468

[45] Jan. 6, 1981

[54] ROOFING MACHINE

[75] Inventor: Walter K. Boyd, Riverside, Calif.

[73] Assignee: Mechanization Systems Company, Laguna Hills, Calif.

[21] Appl. No.: 46,216

[22] Filed: Jun. 7, 1979

[51] Int. Cl.[3] ..... B44C 7/00; B65N 75/38; B65N 75/18; B65N 17/02

[52] U.S. Cl. ..... 156/577; 242/86; 242/72 R; 242/68

[58] Field of Search ..... 156/574, 575, 577; 242/86.52, 72, 68

[56] References Cited

U.S. PATENT DOCUMENTS

| | | | |
|---|---|---|---|
| 466,228 | 12/1891 | Ford | 242/72 |
| 537,789 | 4/1895 | Sinclair | 242/72.1 |
| 1,278,272 | 9/1918 | Wilson | 156/577 |
| 3,332,827 | 7/1967 | Griffith | 156/577 |
| 4,084,763 | 4/1978 | Zamboni | 242/86.52 |

*Primary Examiner*—Douglas J. Drummond
*Attorney, Agent, or Firm*—Gordon L. Peterson

[57] ABSTRACT

A machine for laying a roll of sheet material comprising a frame, a roller rotatably mounted on the frame and a pair of wheels rotatably mounted on the frame. An expandable mandrel is provided for mounting the roll of sheet material. The mandrel is mounted on the frame by two sets of jaws, each of which is controlled by a double set of toggle mechanisms.

18 Claims, 10 Drawing Figures

Fig. 4
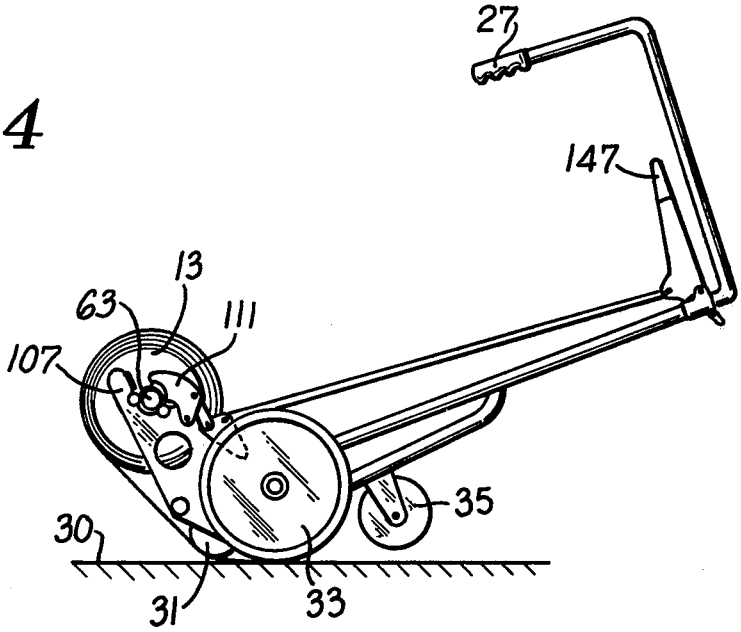
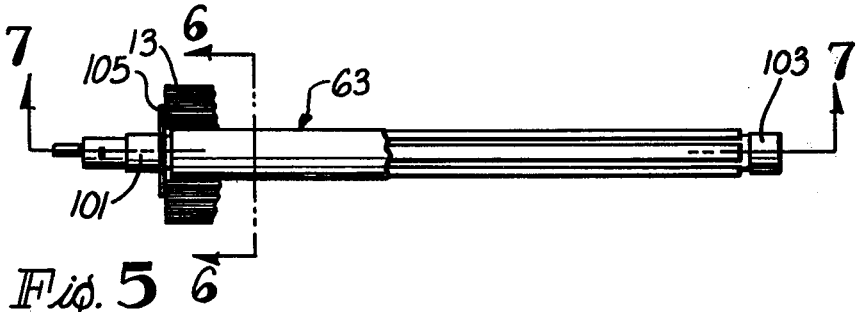
Fig. 5
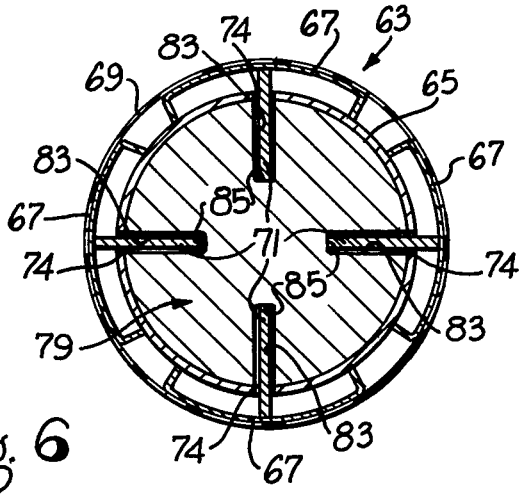
Fig. 6

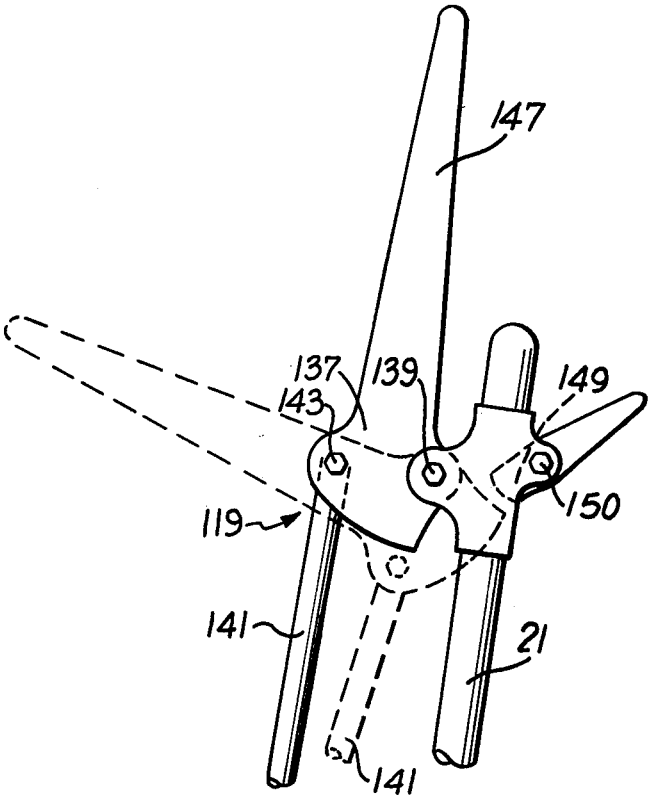
Fig. 9
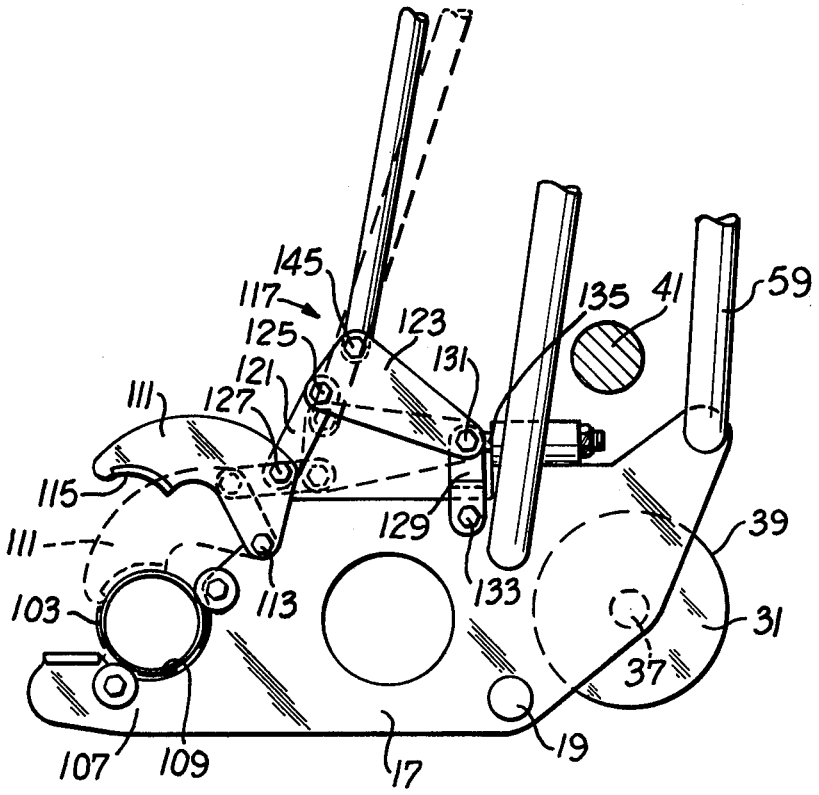

ROOFING MACHINE

BACKGROUND OF THE INVENTION

The structural portion of the roof of many buildings includes a deck constructed of wood, concrete, steel or other structural materials. In order to waterproof the deck, it is necessary to apply a roofing membrane to the deck. One roofing membrane commonly utilized for roofs of minimum pitch, such as are commonly found on industrial and commercial buildings, is a built-up roof. A built-up roof comprises alternate layers of roofing felt and hot or cold asphalt.

Roofing felt is a flexible sheet material commonly provided in rolls. The felt may be constructed, for example, of a mat of asbestos, rag, fiberglass, etc. impregnated or coated with bitumen.

A primary problem with a built-up roof is in laying the roofing felt. One way to accomplish this is to unroll the felt by hand; however, this is a very time-consuming process. Various machines for unrolling the rolls of roofing felt have been proposed, but difficulty has been encountered in causing the machine to move along a perfectly straight line while unrolling the felt. Maintaining a straight line while unrolling a wide sheet of flexible material is always difficult, but the problem is made more accute with roofing felt because the rolls are often not cylindrical. In addition, if an incorrect line is established, it is difficult to unpeel the felt and begin anew due to the adhesive nature of the previously poured layer of asphalt.

SUMMARY OF THE INVENTION

This invention provides a machine which generally overcomes the disadvantages noted above with the prior art. With the machine of this invention, roofing felt or other sheet material provided in roll form can be rapidly unrolled from its roll along an accurately preestablished line.

The machine of this invention preferably includes a frame, wheel means adapted to rollingly engage a supporting surface and means for mounting the wheel means on the frame for rotational movement about a first rotational axis so that the machine can be rolled along the supporting surface. To provide for accurately unrolling the roll of roofing felt or other sheet material, the machine accurately mounts the roll on the machine for rotational movement about a rotational axis of the wheel means. This can be advantageously accomplished by utilizing a radially expandable rollmounting means, such as a mandrel. More specifically, the mandrel is inserted into the central axial opening of the roll and is then radially expanded into tight engagement with the roll. The mandrel is mounted on the frame for rotational movement about an axis parallel to the axis of the wheel means, and this assures that the roll axis and the wheel means axis are parallel.

Although the mandrel can be of different constructions, it can advantageously include an elongated hollow tube, a plurality of rails extending longitudinally of the tube on the exterior thereof and means for mounting the rails on the tube for movement generally radially of the tube. A wedge within the tube can be used to force the rails radially outwardly, and an appropriate spring can be used to bias the rails radially inwardly.

The wheel means includes an elongated roller for pressing the sheet material into the asphalt or other bonding material. The wheel means also preferably includes first and second wheels which can be used in lining up the machine prior to unrolling the sheet material from the roll. The wheels are mounted on the frame for rotation together so that no relative angular movement between the wheels is possible. This assures that the machine will move along a perfectly straight line when the machine is rolled along a supporting surface by the wheels. The frame is tiltable so that it can be rolled along on the roller or on the wheels.

The roll of sheet material may be relatively heavy, and to facilitate mounting the roll on the frame, means is provided to enable the machine to pick up the mandrel when the roll is lying on a supporting structure with the mandrel inserted therein. A quick release mechanism can advantageously be used to provide for rapid mounting and removal of the mandrel. In addition, the mandrel mounting means can permit the mandrel to rotate freely on the frame or provide varying degrees of resistance to rotation, as well as a positive lock against rotation.

These concepts can be advantageously implemented by utilizing first and second sets of jaws for mounting the mandrel. Each of the sets of jaws includes a first jaw coupled to the frame and a movable jaw pivotably mounted on the frame for movement toward and away from the first jaw. Each of the movable jaws is moved by a lower over-center toggle mechanism. The lower over-center toggle mechanism is in turn preferably operated by an upper over-center toggle mechanism.

The frame preferably includes two sets of handles, one for controlling the machine when it is rolling on the roller and the other for controlling the machine when it is rolled on the wheels. To facilitate operator access to the roll of sheet material on the machine, the frame can advantageously include first and second side sections which define an opening of substantial size to allow the workmen utilizing the machine to have easy access to both sides of the machine.

The invention, together with further features and advantages thereof, may best be understood by reference to the following description taken in connection with the accompanying illustrative drawings.

BRIEF DESCRIPTION OF THE DRAWINGS

FIG. 4 is a side elevational view similar to FIG. 1 with the roofing machine tilted so as to be supported by the wheels.

FIG. 5 is a front elevational view of a preferred mandrel with a roll of roofing felt on the mandrel.

FIG. 6 is an enlarged sectional view taken generally along line 6—6 of FIG. 5 with the roll of roofing felt removed and with the mandrel in the collapsed condition.

FIG. 9 is an enlarged elevational view taken generally along line 9—9 of FIG. 2 and illustrating the operation of the upper and lower toggle lever mechanisms.

DESCRIPTION OF THE PREFERRED EMBODIMENT

Figure 1:
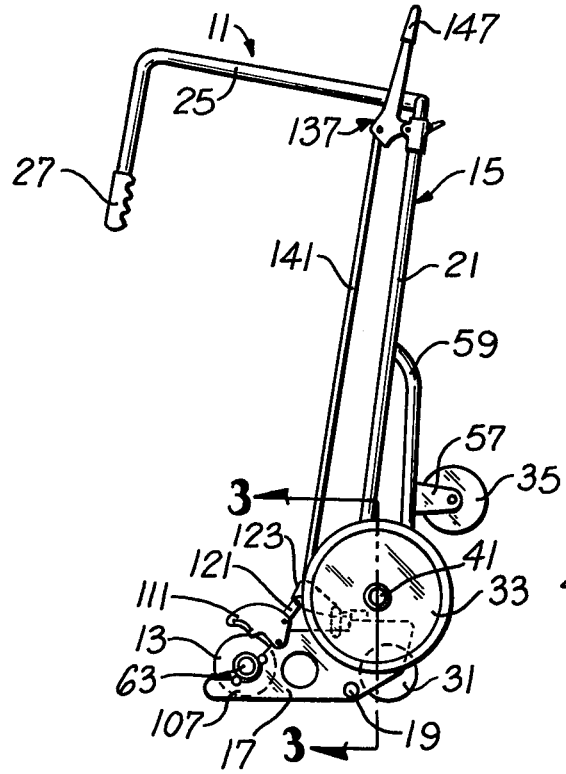
FIG. 1 is a side elevational view of a roofing machine constructed in accordance with the teachings of this invention with the jaws open and the mandrel on the fixed jaws.
Figure 2:
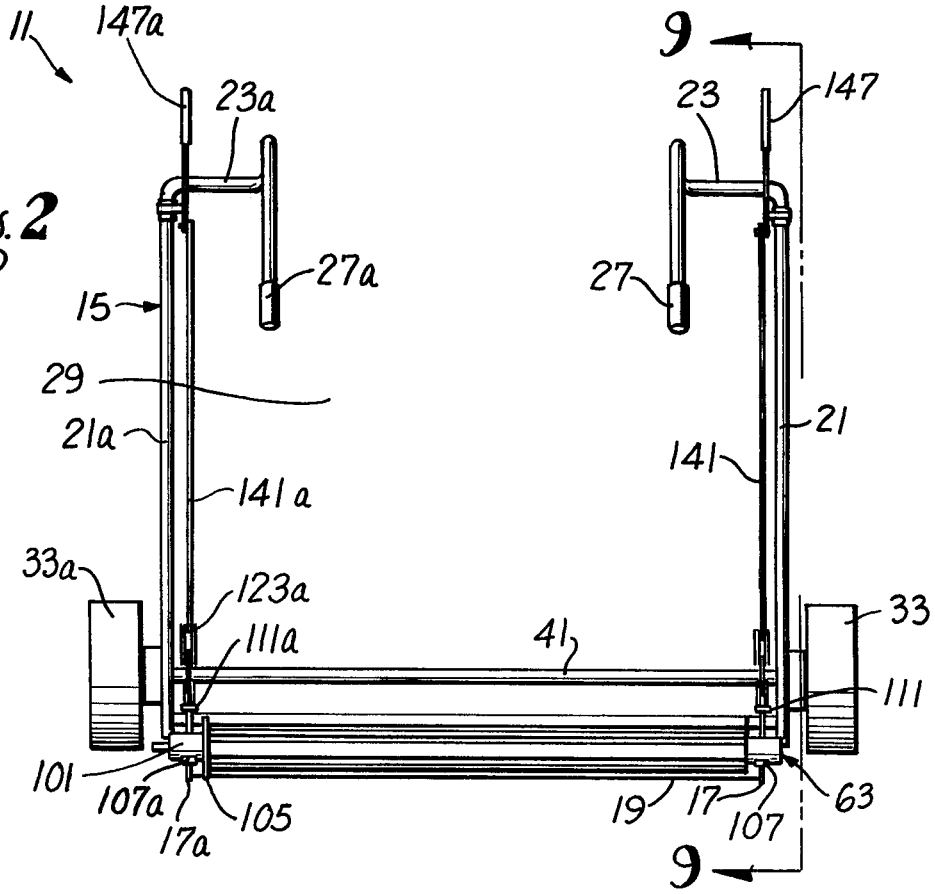
FIG. 2 is a front elevational view of the roofing machine.

FIGS. 1 and 2 show a roofing machine 11 for use in laying a roll 13 (FIG. 4) of roofing felt or other flexible sheet material in roll form. The roofing machine 11 includes a frame 15 comprising spaced apart side plates 17 and 17*a* (FIG. 2) rigidly interconnected by cross members 19. Posts 21 and 21*a* are suitably coupled to the side plates 17 and 17*a*, respectively, and project upwardly therefrom.

At a convenient height above the side plates 17 and 17*a*, each of the posts 21 and 21*a* is bent inwardly to define a first set of handles 23 and 23*a*. The post 21 has a forwardly extending section 25 (FIG. 1) which extends forwardly of, and perpendicular to, the handle 23 and a second handle 27 which extends downwardly perpendicular to the section 25 and parallel to the section of the post 21 which extends upwardly from the side plate 17. The post 21*a* is similarly configured and has a second handle 27*a*. The post 21*a* is similarly configured and has a second handle 27*a*. The posts 21 and 21*a* define, in effect, first and second side sections which define an opening 29 (FIG. 2) of substantial size therebetween. This allows a workman utilizing the machine and standing on one side of the machine to have easy access to the other side of the machine through the opening 29.

Wheel means is rotatably mounted on the frame 15 to support the machine 11 on a supporting surface 30 (FIG. 4). Although various different kinds of wheel means can be employed, preferably such means includes an elongated roller 31 (FIGS. 1, 4 and 9) and a pair of wheels 33 and 33*a* (FIG. 2). If desired, the machine 11 may also include an optional wheel 35 (FIGS. 1 and 4).

A primary function of the roller 31 is to press the roofing felt into the previously poured layer of asphalt. The roller 31 is mounted for rotational movement about a first rotational axis by a shaft 37 (FIG. 9) which extends between the side plates 17 and 17*a*. The roller 31 extends for substantially the complete distance between the side plates 17 and 17*a*. The roller 31 is preferably constructed of a material which will not stick to the bonding material, such as asphalt, utilized to retain the roofing felt. For example, the roller 31 may be constructed of silicone rubber. The roller 31 has a smooth, cylindrical peripheral surface 39.

The machine 11 can be tilted to various different positions by the workman utilizing the handles 23, 23*a*, 27 and 27*a*. By tilting the machine 11 slightly clockwise from the position in FIG. 1, the roller 31 will engage the supporting surface 30 and will rollingly support the machine on the supporting surface. In this position, the handles 23 and 23*a* are used. Because of the long axial dimension of the roller 31, the machine 11 rolls along a linear path when the roller is used to rollingly support the machine.

The wheels 33 and 33*a* can be mounted on the frame 15 in different ways. However, it is important that they be mounted for rotation about a second rotational axis which is parallel to the rotational axis of the roller 31. It is also important that the wheels 33 and 33*a* be of equal diameter and that they be interlocked to rotate together. In the embodiment illustrated, this is accomplished by mounting the wheels on an axle 41 which is in turn suitably mounted by bearings on the side plates 17 and 17*a*.

The roofing machine 11 can be tilted to the position shown in FIG. 4, and in this position, the roofing machine is rollably supported by the wheels 33 and 33*a*, and the roller 31 is spaced upwardly from the supporting surface 30. One purpose of the wheels 33 is to establish the desired linear path along which the roofing machine 11 is to be moved. Because the wheels 33 and 33*a* have equal diameters and because they are locked together, rolling of the roofing machine 11 on the wheels 33 and 33*a* causes the machine to travel along a linear path. Moreover, because the axis of rotation of the wheels 33 and 33*a* is the same as the axis of rotation of the roller 31, the machine will roll along the identical linear path when it is rollingly supported by the roller 31.

Figure 3:
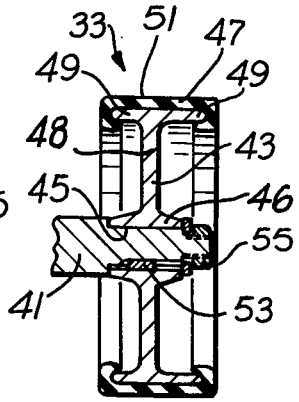
FIG. 3 is an enlarged fragmentary sectional view taken generally along line 3—3 of FIG. 1 and showing a preferred construction for one of the wheels.

Although the wheels 33 and 33*a* can be constructed in different ways, a preferred construction for the wheel 33 is shown in FIG. 3. The wheel 33 includes a rigid wheel member 43, such as an aluminum casting, having an axial passage 45 for receiving one end of the axle 41. As shown in FIG. 3, the wheel member 43 includes a hub 46 having the axial passage 45 therein, a web 48 joined to the hub and extending generally radially outwardly of the hub and flanges 49 joined to the web radially outwardly of the hub and extending generally axially of the web in opposite directions. An outer extruded layer 47 of silicone rubber or other material which will not stick to the asphalt is wrapped around the wheel member 43 and the flanges 49 to provide a cylindrical peripheral surface 51 for the wheel 33. As shown in FIG. 3, the flanges 49 terminate in opposite ends and the layer 47 is wrapped around the opposite ends of the flanges 49. The opposite ends of the extruded layer 47 can be attached by an adhesive or in a vulcanizing process. The wheel 33 shown in FIG. 3 is inexpensive in that a very long strip of the layer 47 can be extruded and then cut to appropriate lengths for use in the wheels.

The wheel 33 can be fixedly mounted on the axle 41 for rotation therewith by a key 53. A nut 55 retains the wheel 33 on the axle 41.

The wheels 33 and 33*a* and the roller 31 enable the machine 11 to move along a single linear path. To facilitate a change of direction of the roofing machine 11, the single wheel 35 may be provided, if desired. In the embodiment illustrated, the wheel 35 is suitably mounted on a bracket 57 (FIG. 1) carried by a frame member 59, the opposite ends of which are suitably coupled to the post 21 and to the side plates 17. By tilting the roofing machine 11 slightly clockwise from the position shown in FIG. 4, the wheel 35 engages the supporting surface, and both the roller 31 and the wheel 33 are raised above the supporting surface. In this position, the direction of movement of the roofing machine 11 can be easily changed by the workmen using the wheels 33*a* and 35.

The roll 13 of roofing felt is provided by rolling the roofing felt up and leaving a central opening 61 (FIG. 7) which extends axially completely through the roll. If desired, the flexible material may be wound on a tube 62.

In the embodiment illustrated, a mandrel 63 is used to mount the roll 13 on the frame 15 (FIGS. 5–8). The mandrel 63 includes an elongated hollow tube 65 of cylindrical configuration and constructed of a suitable metal and a plurality (four being illustrated) of rails 67 extending longitudinally of the tube on the exterior thereof. The rails are resiliently biased inwardly by an elastic rubber tube 69 which extends completely around the rails and the tube 65. In the embodiment illustrated, the elastic tube 69 completely encases the cylindrical periphery of the tube 65 to protect the moving parts of the mandrel from dirt. However, the tube 69 may be provided in the form of one or more separate bands, if desired.

Figure 7:
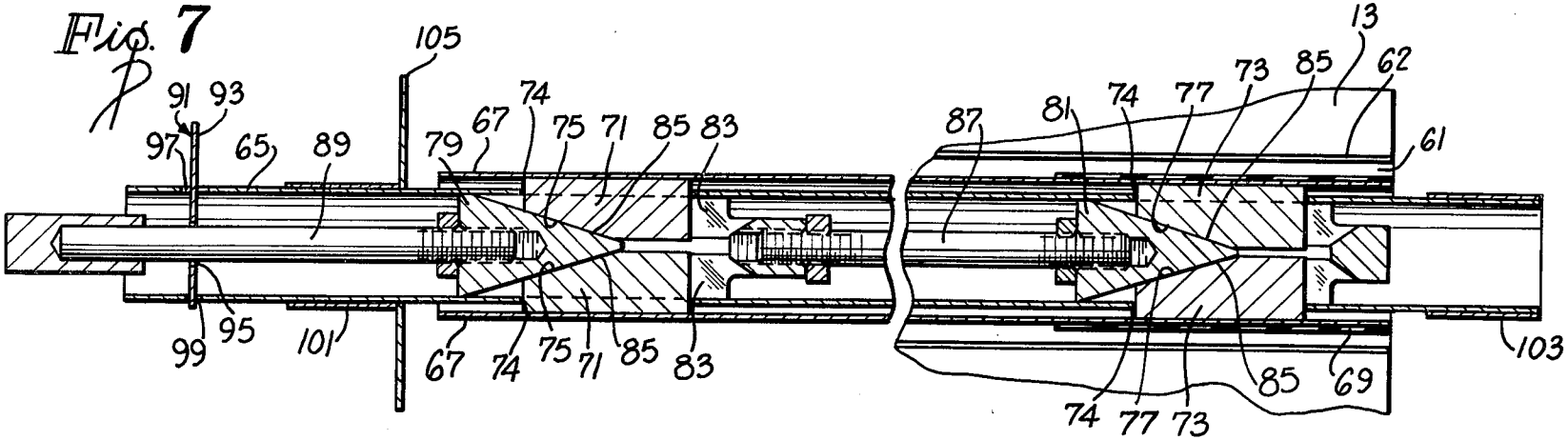
FIG. 7 is an enlarged sectional view taken generally along line 7—7 of FIG. 5 showing the mandrel in the collapsed position.
Figure 8:
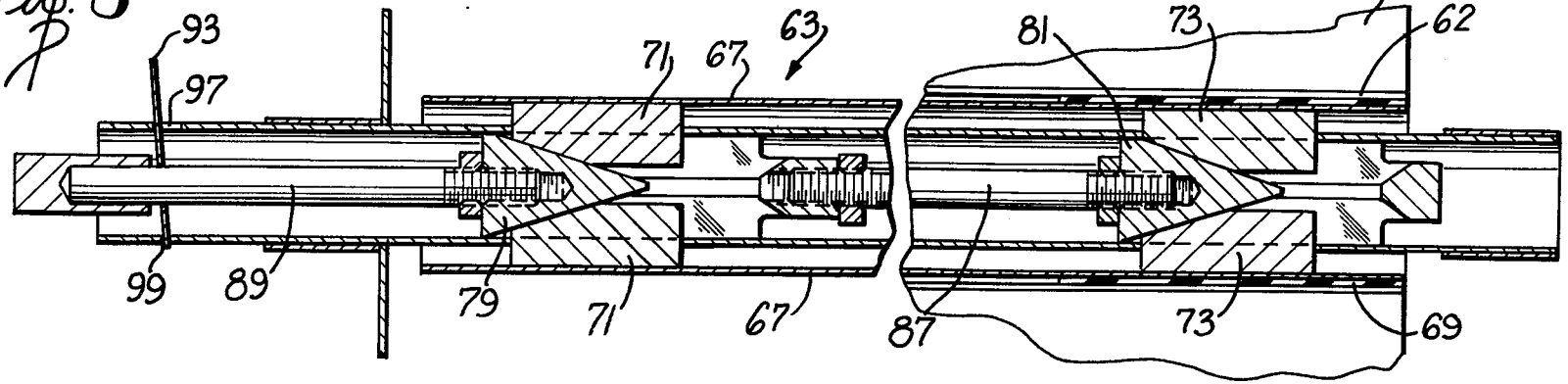
FIG. 8 is a sectional view similar to FIG. 7 with the mandrel in a radially expanded position.

The rails 67 are mounted for movement radially of the tube 65 by wedge elements 71 and 73 which project through slots 74 in the tube 65. As shown in FIG. 7, the wedge elements 71 are spaced axially from the wedge elements 73, and each of the rails 67 has one of the wedge elements 71 and one of the wedge elements 73 associated therewith. In the embodiment illustrated, the wedge elements 71 and 73 are coupled to the associated rails 67, but this is not necessary. The wedge elements 71 have cam surfaces 75, and the wedge elements 73 have similar cam surfaces 77 with all of the cam surfaces extending radially outwardly as they extend axially to the left as viewed in FIG. 7.

Although the radial position of the rails 67 can be adjusted in different ways, in the embodiment illustrated, this is accomplished by wedge means which comprises axially spaced wedge sections 79 and 81 which cooperate with the wedge elements 71 and 73, respectively. The wedge sections 79 and 81 may be identical. The wedge section 79 includes a block mounted for axial sliding movement within the tube 65 and having radial slots 83 for receiving the wedge elements 71, respectively. Portions of the slots 83 are arranged to form ramps 85 which cooperate with the cam surfaces 75. As shown in FIG. 7, the slots 83 extend completely radially through the wedge section 79 at locations spaced axially from the ramps 85. This enables the wedge element 71 to move radially inwardly to a position in which the opposite wedge elements contact each other. In other words, the presence of the wedge section 79 does not require radial enlargement of the mandrel 63. Corresponding reference numerals are used to designate corresponding portions of the wedge sections 79 and 81.

The mandrel 63 can be radially expanded by forcing the rails 67 radially outwardly. To accomplish this, the wedge sections 79 and 81 are coupled by a threaded rod 87 (FIG. 7), the left end of which (as viewed in FIG. 7) is attached to the wedge section 79 at a location spaced axially from the wedge elements 71. An operating rod 89 is attached by threads to the wedge section 79 and projects axially to a location outside the tube 65. By manually pushing on the rod 89, the axial positions of the wedge sections 79 and 81 are adjusted to cam the rails 67 to the desired radial position. For example, by moving the rod 89 to the right to the position shown in FIG. 8, the rails 67 are cammed outwardly against the radial inwardly biasing force of the elastic tube 69 to move the elastic tube 69 into tight frictional engagement with the inner surface of the roll 13. Thus, by radially expanding the mandrel 63, the roll 13 is firmly mounted on the mandrel, and by moving the mandrel radially inwardly, the roll can be easily removed from the mandrel.

The rod 89 can be locked in the desired axial position by any suitable lock. In the embodiment illustrated, a lock 91 comprising a tab 93 having an aperture 95 through which the rod 89 projects is utilized. The tab 93 extends generally radially through the tube 65 by passing through a relatively large hole 97 and a relatively smaller hole 99. When the rod 89 attempts to move to the left from the position shown in FIG. 8, the tab 93 moves to the canted position illustrated and binds on the rod 89 to prevent the rod from moving to the left. Locking devices of this type are known per se.

The mandrel 63 also includes suitable sleeve bearings 101 and 103 which are suitably mounted on the tube 65 adjacent the opposite ends thereof. A guide plate 105 is mounted on the tube 65 at the axial inner end of the bearing 101 for the purpose of guiding the roll 13 as shown in FIG. 5.

The roofing machine 11 includes mandrel mounting means for mounting the mandrel on the frame 15 about an axis which is parallel to the axes of the roller 31 and the wheels 33 and 33*a*. Although this can be accomplished in different ways, in the embodiment illustrated, this is accomplished by two sets of jaws on the side plate 17 and 17*a*. Because these sets of jaws and their operating means are identical, only one set is described herein with corresponding reference numerals followed by the letter "a" being utilized to designate corresponding parts of the other set of jaws and the operating means therefor.

With reference to FIG. 9, the side plate 17 defines a fixed jaw 107 integral therewith and having a smooth curved bearing surface 109 sized to slidably receive the bearing 103 of the mandrel 63. A movable jaw 111 is pivotably mounted on the side plate 17 in any suitable manner, such as by a pin 113 which defines a pivot axis for the movable jaw. The movable jaw 111 has a curved bearing surface 115. Jaws 107*a* and 111*a* (FIG. 2) are similarly provided on the side plate 17*a* for cooperation with the bearing 101 of the mandrel 63.

The movable jaw 111 has an open position shown in full lines in FIG. 9 in which the bearing surfaces 109 and 115 are widely spaced to readily receive the bearing 103 of the mandrel. The movable jaw 111 can be pivoted toward the fixed jaw 107 to a mounting position in which the mandrel 63 is mounted and retained on the frame 15. The mounting position defines a limited range of positions. For example, the mounting position includes a bearing position in which rotation of the bearing 103 and the mandrel 63 relative to the frame is freely allowed. In addition, the mounting position includes a drag position in which the movable jaw 111 is moved farther toward the fixed jaw 107 to frictionally restrain the mandrel 63 to any degree desired against rotation. For example, the frictional resistance may be set so as to be relatively small or it may be sufficient to effectively lock the mandrel 63 against rotation.

The movable jaw 111 is moved by a lower toggle mechanism 117 which is in turn operated by an upper toggle mechanism 119. The lower toggle mechanism comprises levers 121 and 123 pivotally interconnected adjacent confronting ends thereof by a pin 125. The opposite end of the lever 121 is coupled to the movable jaw 111 by a pin 127, and the remote end of the lever 123 is coupled to an adjustment arm 129 by a pin 131 which is in turn pivotally mounted on the side plate 17 by a pin 133. The outer end of the arm 129 engages an adjustable stop 135 of conventional construction which is mounted on the side plate 17.

The levers 121 and 123 are toggle levers. By pivoting the lever 123 counterclockwise as viewed in FIG. 9, the movable jaw 111 is moved toward the fixed jaw 107. Furthermore, if movement of the lever 123 counterclockwise is sufficient, the levers move over center so as to lock the movable jaw 111 in the mounting position in which the mandrel 63 is retained on the frame 15. The adjustable stop 135 can be adjusted to adjust the position of the movable jaw in relation to the toggle levers 121 and 123.

The upper toggle mechanism 119 includes a lever or crank 137 pivotally attached by a pin 139 to the post 21 and a long link or lever 141 pivotally attached to the crank and the lever 123 by pins 143 and 145, respectively. The crank 137 has an operating handle 147 integral therewith, and the pivotal motion of the crank 137 in the counterclockwise direction as viewed in FIG. 9 is limited by an adjustable stop 149 affixed to the post 21 by a fastener 150. By loosening the fastener 150, the angular position of the stop 149 can be adjusted to alter the location at which the crank 137 will abut the stop.

By manually pivoting the handle 147 counterclockwise from the position shown in full lines in FIG. 9 to the position shown in phantom lines, the link 141 is urged downwardly to move the lower toggle mechanism 117 over center to move the movable jaw 111 to the mounting position shown in dashed lines in FIG. 9. In this position, the upper toggle mechanism 119 is approaching its center position but has not swung through center. The linkage will remain in this position because the lower toggle mechanism 117 is over center, and the movable jaw 111 is engaging the bearing 103 of the mandrel 63. The arrangement is such that, in the position shown in dashed lines in FIG. 9, the bearing 103 is held in the jaws 107 and 111 and can freely rotate therein. Although the toggle mechanisms 117 and 119 can go over center simultaneously, preferably the mechanism 117 goes over center first.

Figure 10:
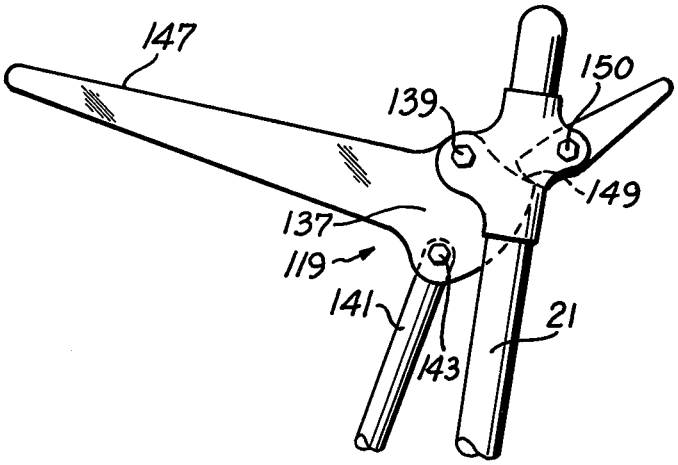
FIG. 10 is a view similar to FIG. 9 with the upper toggle mechanism over center and the jaws in a position to apply some drag to the mandrel.
Figure 10:
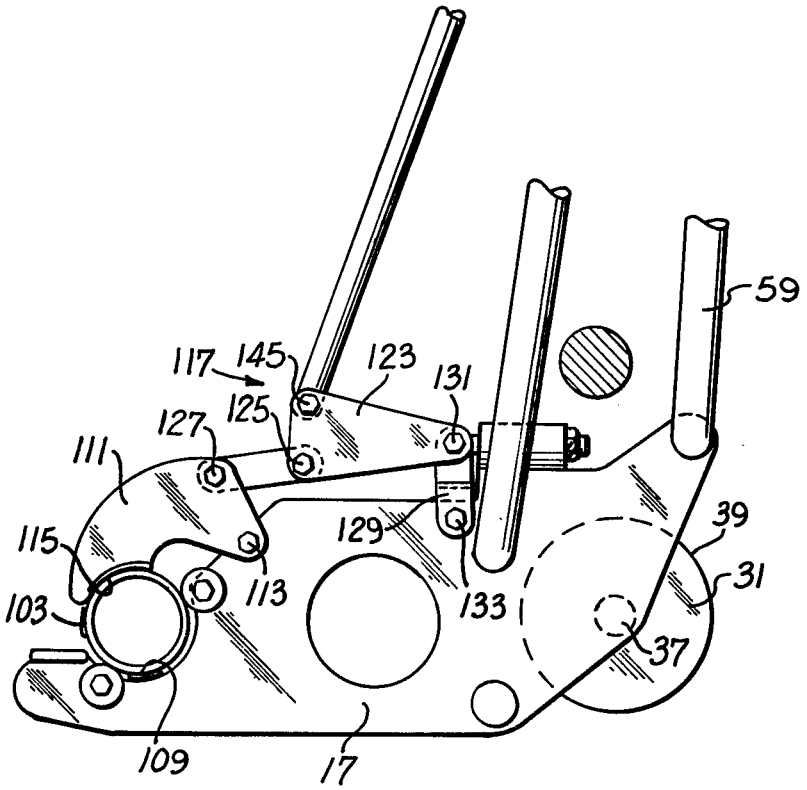

By moving the crank 137 clockwise from the dashed position shown in FIG. 9 to the position shown in FIG. 10, the upper toggle mechanism 119 is moved through center, and the crank 137 abuts the adjustable stop 149. As the upper toggle mechanism moves between these positions, the link 141 is first urged downwardly from the position shown in dashed lines in FIG. 9 and then back upwardly as the upper toggle mechanism 119 passes through center and comes to rest against the adjustable stop 149. The upward motion of the link 141 raises the lever 123 so as to move the lower toggle mechanism 117 back toward its center position. This pivots the movable jaw 111 slightly toward the fixed jaw 107 to cause the bearing 103 to be frictionally gripped between the jaws. The degree to which the bearing 103 is frictionally gripped can be varied. For example, the jaws 107 and 111 can grip the mandrel 63 sufficiently to lock it against rotation, whereas the other set of jaws 107*a* and 111*a* (FIG. 2) in the corresponding position, may be set to apply a slight frictional drag to resist, but not prevent, rotation of the mandrel 63.

In use of the roofing machine 11, the mandrel 63 is removed from the frame 15 and manually inserted into the roll 13. The mandrel 63 is then radially expanded by advancing the rod 89 to the right from the position shown in FIG. 7 to the position shown in FIG. 8. This tightly frictionally retains the mandrel within the roll 13.

The operator then advances the roofing machine 11 with the jaws 107 and 111 open toward the mandrel 63. Using the open jaws, the mandrel is picked up by the roofing machine 11 with the bearings 101 and 103 being received in in the two sets of jaws. The two sets of jaws are then moved to the mounting position with the jaws being set to either permit free rotation of the mandrel 63 or to slightly frictionally retard rotation. In either event, this mounts the mandrel 63 and the roll 13 for rotation about an axis which is parallel to the axes of rotation of the roller 31 and the wheels 33 and 33*a*.

To establish the correct line along which the roll is to be unrolled, the operator tilts the machine so that it is supported on the wheels 33 and 33*a* as shown in FIG. 4 and rolls it back and forth using the handles 27 and 27*a* in a trial and error process to determine the correct line for the machine. The wheel 35 can be used to support the roofing machine 11 to make adjustments in the direction of the path. During this time, the operator has easy access to the roll 13 from the righthand side of the machine as viewed in FIG. 1 by simply stepping through the large opening 29. Also during this time, the roll 13 of material is preferably partially unrolled and run back beneath the machine 11 as shown in FIG. 4.

After the correct line has been established, the operator tilts the posts 21 counterclockwise from the position of FIG. 4 so that the machine is supported by the roller 31 and pushes the machine along using the handles 23 and 23*a* with the roll unrolling behind the machine. In use, the machine is pushed to the left as viewed in FIG. 4 with the sheet material unrolling from the roll 13 and passing beneath the roller 31 to be compressed against the previously laid layer of asphalt. When the roofing machine 11 is at rest as shown in FIG. 1, it is supported by the side plates 17 and 17*a*, and the roller 31 and the wheels 33, 33*a* and 35 are not in contact with the supporting surface 30.

Although an exemplary embodiment of the invention has been shown and described, many changes, modifications and substitutions may be made by one having ordinary skill in the art without necessarily departing from the spirit and scope of this invention.

I claim:

1. A machine for laying a roll of sheet material wherein the roll has a central opening, said machine comprising:

a frame;

wheel means adapted to rollingly engage a supporting surface;

means for mounting said wheel means on said frame for rotational movement about a first rotational axis whereby the machine can be rolled along the supporting surface;

expandable roll mounting means insertable into the central opening of the roll of sheet material;

means for radially expanding the roll mounting means into tight engagement with the roll;

first means for mounting said roll mounting means on said frame for rotation about a second rotational axis, said first and second rotational axes being parallel whereby the sheet material can be accurately unrolled from the roll as the machine moves along the supporting surface; and a wheel means including an elongated roller for pressing the sheet material unrolled from the roll into the supporting surface.

2. A machine as defined in claim 1 wherein said roll mounting means includes an elongated mandrel extendable completely through the central opening of the roll.

3. A machine as defined in claim 1 wherein said roll mounting means includes quick release means for releasably mounting the roll mounting means on the frame whereby the roll mounting means can be quickly mounted on and removed from the frame.

4. A machine as defined in claim 1 wherein said first mounting means includes a first set of jaws, said first set of jaws including a first jaw and a movable jaw pivotally mounted on said frame for pivotal movement toward and away from the first jaw, a portion of said roll mounting means being receivable between said first jaw and said movable jaw for at least assisting in mounting said roll mounting means on said frame, and said first mounting means including toggle lever means for moving said movable jaw toward and away from the first jaw between a retaining position in which the first jaw and the movable jaw at least assist in retaining the roll mounting means on the frame and an open position in which the roll mounting means can be removed from said first jaw and said movable jaw.

5. A machine as defined in claim 4 wherein said retaining position includes a first position in which the mandrel is rotatable and a second position, said toggle lever means includes first and second over-center toggle mechanisms coupled to said frame and drivingly interconnected to each other so that said first toggle lever mechanism can drive said second toggle lever mechanism, means for coupling said second toggle lever mechanism to said movable jaw, movement of said first toggle lever mechanism in a first phase of movement at least partially on one side of its center position moving said second toggle lever mechanism over center to move said movable jaw to said first position and movement of said first toggle lever mechanism in a second phase movement at least partially on the other side of its center moving said second toggle lever mechanism back toward center to move said movable jaw toward said first jaw to said second position in which said first jaw and said movable jaw grip said roll mounting means sufficiently to resist free rotation thereof.

6. A machine as defined in claim 1 wherein said roll mounting means includes a mandrel, said mandrel includes an elongated hollow tube, a plurality of rails extending longitudinally of said tube on the exterior thereof, means for mounting said rails on said tube for movement generally radially of said tube, at least one wedge element for each of said rails, said wedge elements extending into the interior of said tube and wedge means movable within said tube and engageable with said wedge elements to urge said rails radially outwardly with respect to said tube to expand the mandrel.

7. A machine as defined in claim 6 including first and second axially spaced wedge elements for each of said rails, said wedge means including first and second axially spaced wedge sections, each of said wedge sections including regions of reduced cross section to allow said wedge elements to move radially inwardly of the tube and means spaced from said wedge elements for interconnecting said wedge sections for movement together whereby said last-mentioned means does not interfere with the radial inward movement of the wedge elements.

8. A machine as defined in claim 1 including a direction changing wheel mounted on said frame, said frame being tiltable to a third position at which the machine can roll on said last-mentioned wheel to facilitate changing the direction of movement of said machine.

9. A machine for laying a roll of sheet material comprising:

a frame;

an elongated roller;

means for mounting the elongated roller on the frame for rotation about a first rotational axis;

first and second wheels;

means for mounting said first and second wheels on said frame for rotation about a second rotational axis, said last-mentioned mounting means mounting the first and second wheels for rotation together so that there is essentially no relative angular movement between said first and second wheels about said second rotational axis;

said frame being tiltable and said roller and said wheels being sized and arranged whereby the frame can be tilted between a first position in which the machine can roll along on said roller and a second position in which the machine can roll along on said wheels; and first means for mounting the roll of sheet material on the frame for rotation about a third rotational axis so that the sheet material can be unrolled from the roll as the machine is moved along, said third rotational axis being generally parallel to said first and second rotational axes.

10. A machine as defined in claim 9 wherein said frame includes a first set of handles for manually moving the machine on said wheels and a second set of handles spaced from said first set of handles for moving the machine on said roller.

11. A machine as defined in claim 9 wherein said frame includes first and second side sections having upper and lower ends, at least one cross member interconnecting said side sections adjacent the lower ends thereof, and handle means coupled to said side sections adjacent the upper ends thereof, said roll mounting means extending generally between said side sections, said side sections defining an opening of substantial size therebetween to allow a workman utilizing the machine to have access to both sides of the machine from one side of the machine.

12. A machine for laying a roll of sheet material as defined in claim 9 wherein said first means includes a mandrel mounted on said frame for rotation about said third rotational axis and means for drivingly coupling the roll of sheet material to the mandrel for rotation together.

13. A machine for laying a roll of sheet material as defined in claim 12 including means for resisting the free rotation of the mandrel about the third rotational axis.

14. A machine for laying a roll of sheet material as defined in claim 9 wherein said first wheel includes a rigid wheel member and a layer of material which readily releases from asphalt mounted on and extending around the periphery of said wheel member, said layer having a peripheral surface adapted to rollingly engage a supporting surface.

15. A machine for laying a roll of sheet material comprising:

a frame;

wheel means adapted to roll along a supporting surface;

means for mounting the wheel means on the frame for rotation about a first rotational axis whereby the machine can be rolled along the supporting surface;

first means for mounting the roll of sheet material on the frame so that the sheet material can be unrolled from the roll as the machine is moved along the supporting surface, said first means including first and second sets of jaws and a shaft receivable in said sets of jaws;

each of said sets of jaws including a first jaw coupled to said frame and a movable jaw pivotally mounted on the frame for movement toward and away from the first jaw;

means for moving said movable jaws toward and away from the first jaws;

said jaw moving means including a lower overcenter toggle mechanism for moving the movable jaw of said first set of jaws and means for operating the lower toggle mechanism, said lower toggle mechanism being coupled to said frame and to said movable jaw of said first set of jaws;

said lower toggle mechanism driving the movable jaw closest to the first jaw adjacent the center position of the lower toggle mechanism; and said operating means for said lower toggle mechanism including means coupled to the frame for driving the lower toggle mechanism over center to a first position to move the movable jaw to a bearing position and to a second position nearer center than said first position to move the movable jaw to a drag position in which the movable jaw is closer to the first jaw than in said bearing position, said shaft being rotatable in said bearing position and said first set of jaws resisting rotation of the shaft in said drag position.

16. A machine as defined in claim 15 wherein said operating means for said lower toggle mechanism includes an upper toggle mechanism coupled to said frame and drivingly connected to said lower toggle mechanism whereby the upper toggle mechanism can drive the lower toggle mechanism, said upper toggle mechanism driving said lower toggle mechanism over center in a first phase of movement and moving said lower toggle mechanism back toward its center position in a second phase of movement of said upper toggle mechanism, at least portions of said first and second phases of movement being on opposite sides of the center of said upper toggle mechanism.

17. A machine as defined in claim 15 wherein said wheel means includes first and second wheels and an elongated roller, said wheel mounting means includes means for mounting said wheels on said frame for rotation together and means for mounting said roller on said frame for rotation, said frame being tiltable whereby the machine can roll along on said roller or on said wheels.

18. A machine as defined in claim 15 wherein said wheel means includes at least one wheel, said wheel including a rigid wheel member and a layer of silicone rubber mounted on and extending around the periphery of said wheel member.

* * * * *